US007119786B2

(12) United States Patent
Cui

(10) Patent No.: US 7,119,786 B2
(45) Date of Patent: Oct. 10, 2006

(54) METHOD AND APPARATUS FOR ENABLING POWER MANAGEMENT OF A FLAT PANEL DISPLAY

(75) Inventor: Ying Cui, Mountain View, CA (US)

(73) Assignee: Intel Corporation, Santa Clara, CA (US)

( * ) Notice: Subject to any disclaimer, the term of this patent is extended or adjusted under 35 U.S.C. 154(b) by 53 days.

(21) Appl. No.: 09/896,341

(22) Filed: Jun. 28, 2001

(65) Prior Publication Data

US 2003/0001815 A1 Jan. 2, 2003

(51) Int. Cl.
*G09G 3/36* (2006.01)

(52) U.S. Cl. ..... 345/102; 345/211

(58) Field of Classification Search ..... 345/102, 345/103, 104, 98, 211–213, 214, 87–89, 90, 345/92, 63, 101, 690; 348/602, 227.1; 713/320, 713/340

See application file for complete search history.

(56) References Cited

U.S. PATENT DOCUMENTS

| | | | | |
|---|---|---|---|---|
| 4,958,148 | A * | 9/1990 | Olson | |
| 5,270,818 | A * | 12/1993 | Ottenstein | 348/602 |
| 5,488,434 | A * | 1/1996 | Jung | 348/725 |
| 5,532,719 | A * | 7/1996 | Kikinis | 345/211 |
| 5,854,617 | A | 12/1998 | Lee et al. | |
| 6,111,559 | A * | 8/2000 | Motomura et al. | 345/102 |
| 6,346,937 | B1 * | 2/2002 | Sasaki et al. | 345/211 |
| 6,388,388 | B1 * | 5/2002 | Weindorf et al. | 315/169.3 |
| 6,466,196 | B1 * | 10/2002 | Isogawa et al. | 345/102 |
| 6,611,249 | B1 * | 8/2003 | Evanicky et al. | 345/102 |
| 2001/0022584 | A1 * | 9/2001 | Tsugawa | 345/211 |
| 2002/0003522 | A1 | 1/2002 | Baba et al. | |
| 2004/0000249 | A1 | 1/2004 | Avetisian | |

FOREIGN PATENT DOCUMENTS

| | | | |
|---|---|---|---|
| EP | 0 883 103 | A | 12/1998 |
| EP | 0 888 004 | A2 | 12/1998 |
| EP | 1 111 575 | A1 | 6/2001 |
| JP | 11 213090 | A | 8/1999 |
| JP | 200330542 | A | 11/2000 |
| WO | WO 99/30309 | A1 | 6/1999 |

OTHER PUBLICATIONS

Patent Cooperation Treaty's Written Opinion for International application No. PCT/US02/18738, dated Jul. 10, 2003, 6 pgs.
European Patent Office, European Search Report for Application No. EP 02734789.7, 3 pages, Apr. 21, 2005.
PCT Notification of Transmittal of The International Search Report or The Declaration for PCT Counterpart Application No. PCT/US02/18738 Containing International Search Report (Dec. 5, 2002).

* cited by examiner

*Primary Examiner*—Regina Liang
(74) *Attorney, Agent, or Firm*—Erik M. Metzger

(57) ABSTRACT

A method and apparatus for enabling power management of a flat-panel display is described. In one embodiment, a method involves detecting at least one display device power state and adjusting a backlight brightness in a display monitor in response to the detecting the at least one display power state. In one embodiment, a method further involves altering the brightness of a display image in order to maintain a display image quality when the backlight is adjusted.

25 Claims, 9 Drawing Sheets

VISUAL ACUITY VS DISTANCE FROM FOVEA

METHOD AND APPARATUS FOR ENABLING POWER MANAGEMENT OF A FLAT PANEL DISPLAY

CROSS REFERENCE TO RELATED APPLICATIONS

This application is related to the following co-pending U.S. patent applications: 1) U.S. patent application Ser. No. 10/745,239 entitled, "Method and Apparatus for Characterizing and/or Predicting Display Backlight Response Latency", assigned to the assignee of the present invention and filed Dec. 22, 2003; 2) U.S. patent application Ser. No. 10/367,070 entitled "Real-Time Dynamic Design of Liquid Crystal Display (LCD) Panel Power Management Through Brightness Control," assigned to the assignee of the present invention and filed Feb. 14, 2003; 3) U.S. patent application Ser. No. 10/663,316 entitled, "Automatic Image Luminance Control with Backlight Adjustment", assigned to the assignee of the present invention and filed Sep. 15, 2003; and 4) U.S. patent application Ser. No. 10/882,446 entitled "Method and Apparatus to Synchronize Backlight Intensity Changes with Image Luminance Changes," assigned to the assignee of the present application and filed Jun. 30, 2004.

BACKGROUND

As more functionality is integrated within mobile computing platforms, the need to reduce power consumption becomes increasingly important. Furthermore, users expect increasingly longer battery life in mobile computing platforms, furthering the need for creative power conservation solutions. Mobile computer designers have responded by implementing power management solutions such as, reducing processor and chipset clock speeds, intermittently disabling unused components, and reducing power required by display devices, such as a Liquid Crystal Diode (LCD) or "flat panel" display.

Power consumption in flat-panel display monitors increases with flat panel display backlight brightness. In some computer systems, flat panel display backlight power consumption can soar as high as 6 Watts when the backlight is at maximum luminance. In a mobile computing system, such as a laptop computer system, this can significantly shorten battery life. In order to reduce flat panel power consumption and thereby increase battery life, mobile computing system designers have designed power management systems to reduce the flat-panel display backlight brightness while the system is in battery-powered mode. However, in reducing backlight brightness in a flat panel display, the user is often left with a display image that is of lower quality than when the mobile computing platform is operating on AC power. This reduction in display image quality can result from a reduction in color or brightness contrast among display image features within the display image when backlight brightness is reduced.

Display image quality is further effected by ambient light surrounding a display monitor in which an image is displayed, reducing the number of environments in which a user can use a mobile computing system comfortably. Ambient light brightness effects the display image quality regardless of whether the computer system is operating on battery power.

Finally, display image quality can be affected by a computer program being executed within a computer system. Computer programs that use computer graphics features to generate display images on a display are often created with a particular display monitor type in mind. As a result, the quality of graphics images generated by a computer program may vary across display monitor types.

BRIEF DESCRIPTION OF THE DRAWINGS

The features and advantages will become apparent from the following detailed description in which.

DETAILED DESCRIPTION

The following describes a method and apparatus for enabling power management in a Liquid Crystal Diode (LCD), or "flat panel", display monitor. Flat panel displays are used in a variety of computing environments including Personal Digital Assistants (PDA), laptop computers, and many other devices that can operate on battery power. As with any mobile computing system, power management is vital to preserving battery life. One method of power management includes decreasing backlight luminance (brightness) in a computer system's flat-panel display monitor. However, reducing backlight brightness can effect the quality of the image being displayed by reducing color or brightness contrast among features within the display image such as, text, graphics, and background. Quality of the display image can suffer further as the backlight brightness becomes dimmer than ambient light surrounding a flat-panel display.

Figure 7:
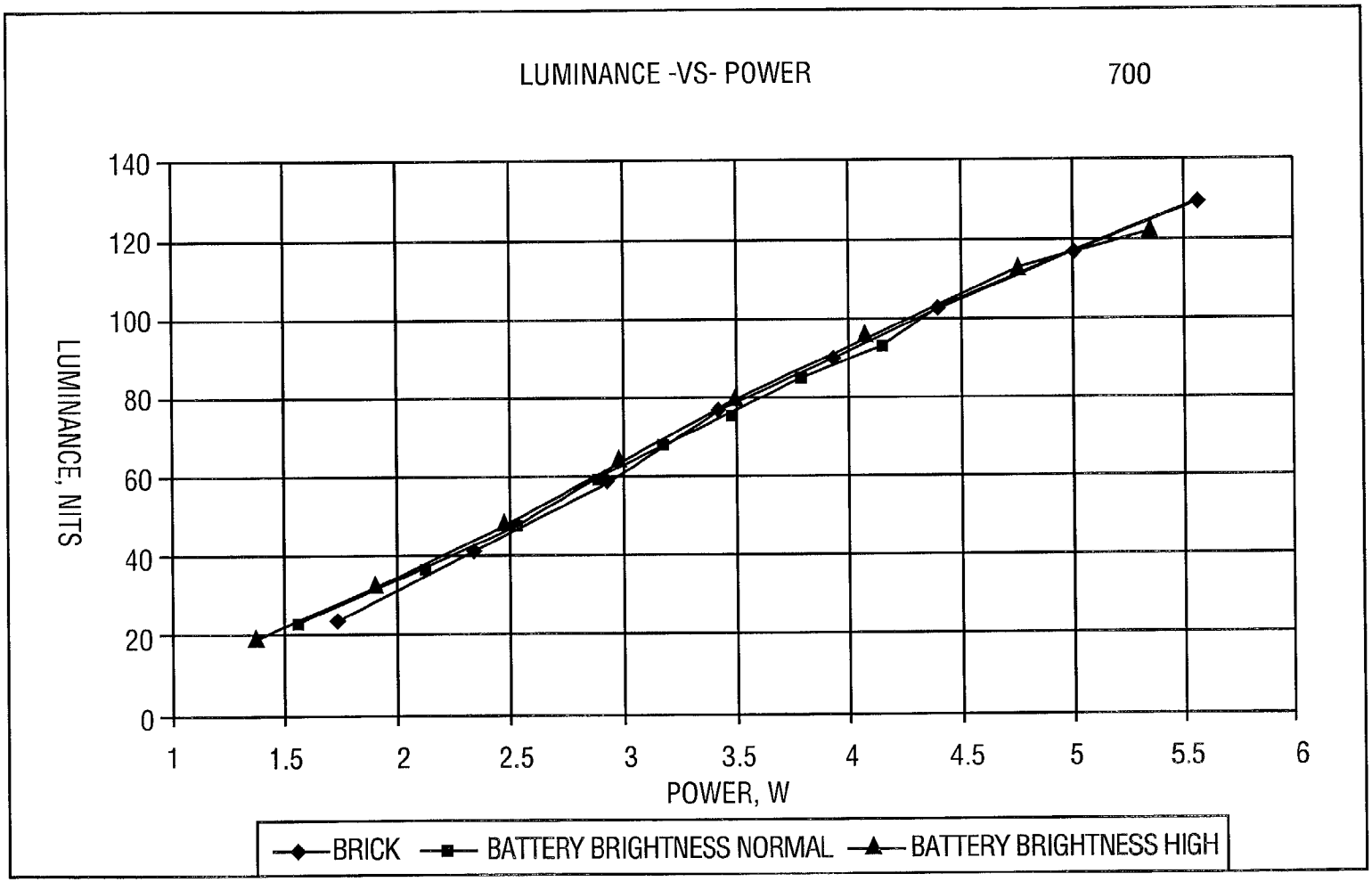
FIG. 7 illustrates a relationship between LCD backlight power and LCD luminance of a mobile computing system

FIG. 7 illustrates the relationship 700 between power consumed by a flat-panel display and the brightness of a backlight within the flat-panel display. As FIG. 7 illustrates, an increase in backlight brightness, causes the power consumed by the flat-panel display monitor to increase in an approximately linear fashion.

It is, therefore, desirable to decrease backlight brightness in a flat-panel display monitor while maintaining a display image quality. Furthermore, it is desirable for a display image brightness to be adjusted in order to achieve or maintain a display image quality regardless of variances in backlight brightness of a flat-panel display or ambient light brightness surrounding a flat-panel display.

Power Management

Several power management specifications exist that define power states for a graphics display device, such as a 3-D graphics accelerator. Some power management specifications may define power states for a display monitor in order to achieve display device power targets. Other power management specifications may define display device power states in order to achieve display device power consumption targets. Display device power states can be defined by power management specifications, such as the Advanced Component Power Interface Specification (ACPI). Display device power states can be defined not only by power consumption targets, but also in terms of other factors, such as the time required to go between power states. ACPI defines several power states that may be satisfied, at least in part, by reducing the power consumed by the display device. For example, ACPI defines a D0 power state, in which a display device or other device within a computer system may be in an "on", or full-power state. ACPI also defines a D1 state from which a device, such as a display device, must be able to return to the D0 power state in a prescribed amount of time. The ACPI timing requirement for transitioning between D0 and D1 power states influences what functionality may be disabled within a display device in order to achieve a particular power target range. Typically, functionality is disabled within a display device that results in the greatest possible power savings while satisfying an ACPI power state timing requirement. In one embodiment, a display device power state can be satisfied, at least in part, by reducing the backlight brightness of a flat-panel display monitor controlled by the display device. A display device power state may be detected in one embodiment by a software program, such as a display device driver. In response to detecting a display device power state, the display device software driver may configure a display device to reduce backlight brightness in a display monitor controlled from the display device.

Power consumption targets may also be defined by computer system manufacturers. For example, a computer system manufacturer may desire to achieve a particular power consumption target in order to meet a certain battery life target when the computer system is running on battery power. In order to achieve a power consumption target, the computer system designer may implement a method to detect when the computer system is operating on battery life as opposed to Alternating Current (AC) power. A computer system designer may then achieve, at least partially, a power consumption target by reducing the amount of power consumed by a display device, such as a 3-D graphics accelerator. Power consumed by a display device may be reduced by reducing a backlight brightness in a flat-panel display monitor being controlled by the display device. Therefore, in order to satisfy a particular power consumption target, a flat-panel display backlight can be reduced to reduce power consumed by a display device.

In one embodiment, the backlight brightness of a flat-panel display monitor controlled from a computer system may be adjusted to satisfy a computer system power consumption target when the computer system is operating on either battery power or AC power. In order to maintain a pre-determined display image quality, a display image brightness may then be detected and adjusted in response to adjusting the flat-panel display monitor backlight brightness. In one embodiment, the display image brightness is detected by display image detectors that indicate display image brightness to a software program. The software program may then configure a device, such as a graphics gamma unit, to adjust the display image brightness, while the power consumption target is achieved or maintained.

A Mobile-Computing Platform

Figure 1:
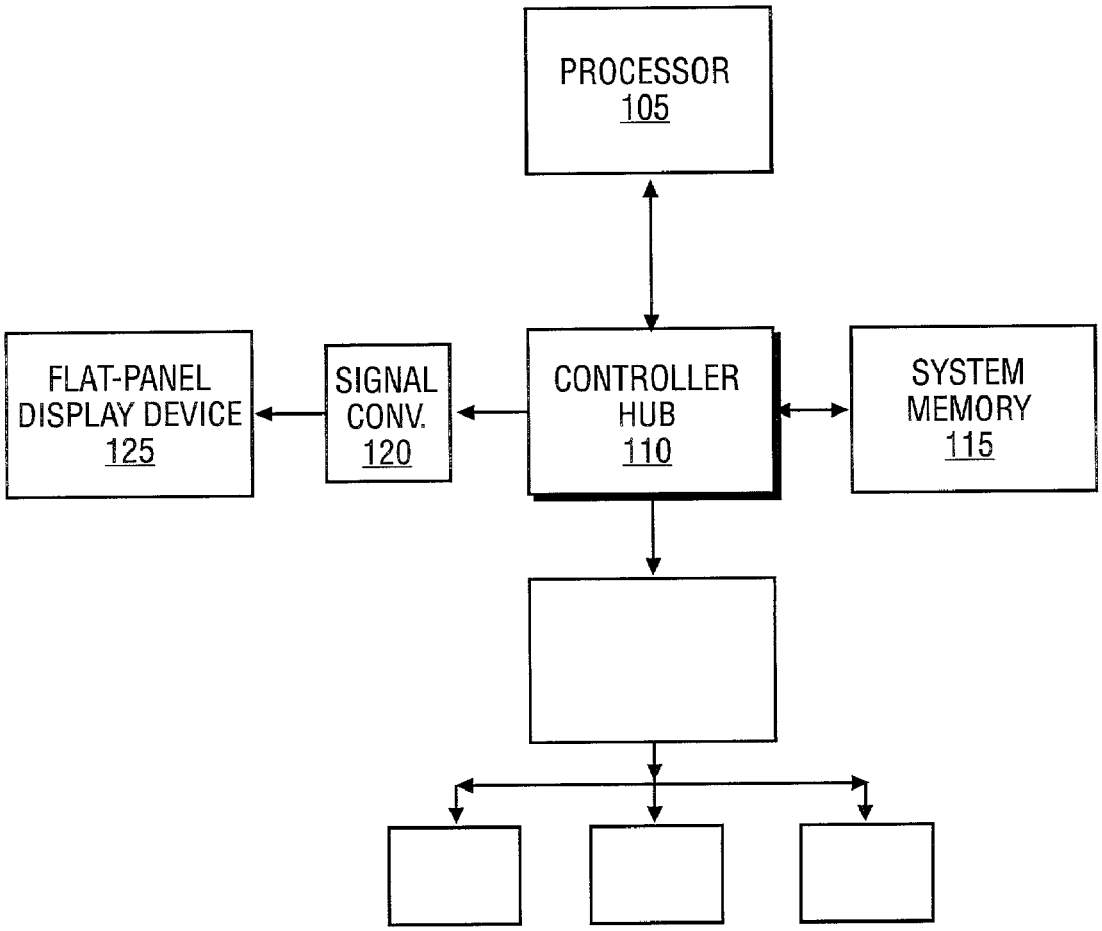
FIG. 1 illustrates a mobile-computing platform in accordance with one embodiment.

FIG. 1 illustrates a mobile computing system in accordance with one embodiment. The flat panel display 125 is coupled to a display device 110 that translates a digital representation of a display image stored in system memory 115 into display signals that are interpreted by the flat-panel display and subsequently displayed on the flat-panel display screen.

Display signals produced by the display device may pass through various control devices 120 before being interpreted by and subsequently displayed on the flat-panel display monitor. In one embodiment, display signals produced by a display device are translated into a format that allow the signals to travel a longer distance without excessive attenuation. The translated display signals may then be translated back to an digital format appropriate to be subsequently displayed on the flat-panel display.

A Flat-Panel Display Monitor

Figure 2:
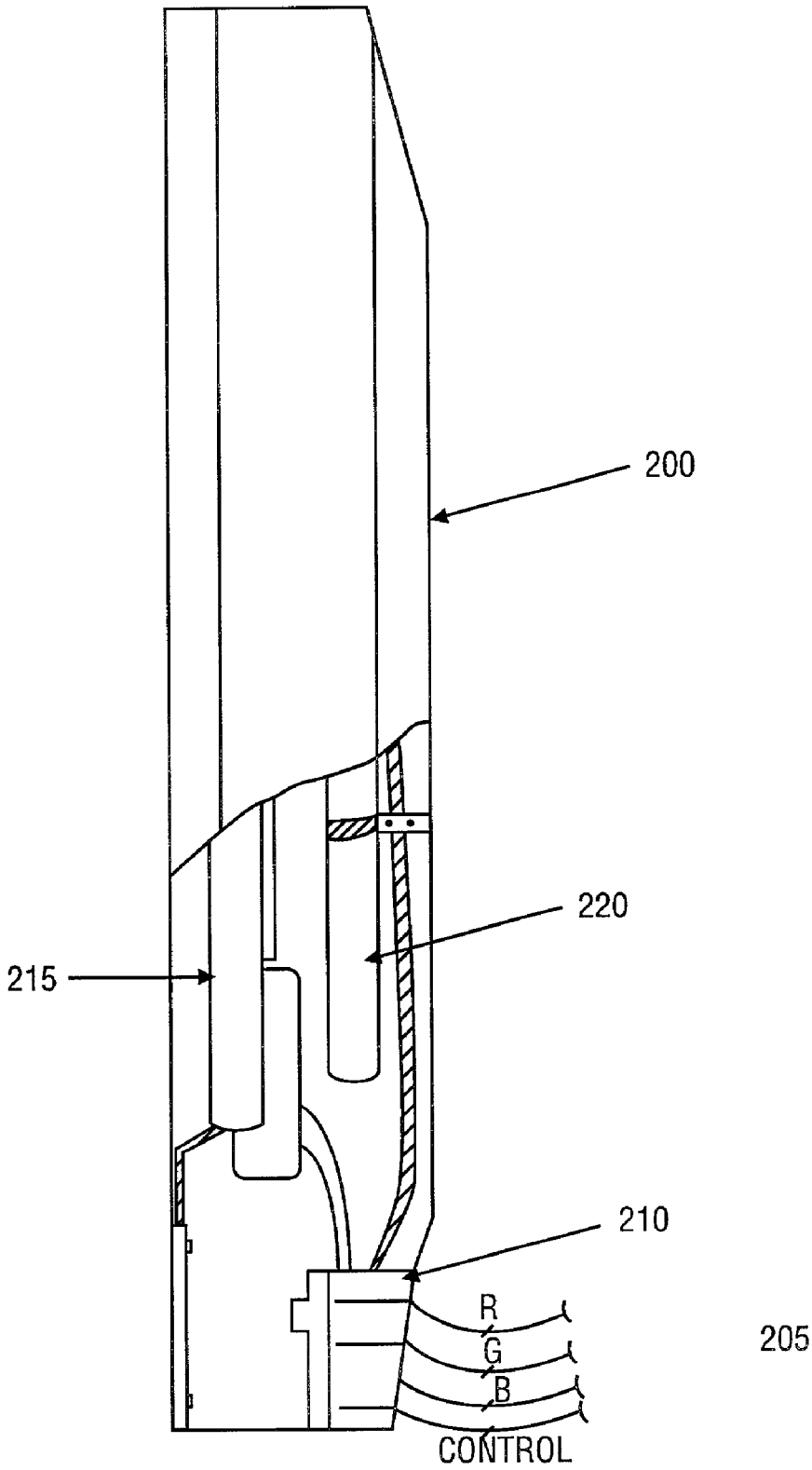
FIG. 2 illustrates a cross-section of a flat-panel display monitor in accordance with one embodiment.

FIG. 2 illustrates a cross-sectional view of a flat panel display monitor 200 in accordance with one embodiment. In one embodiment, display signals 205 generated by a display device, such as a graphics accelerator, are interpreted by a flat-panel monitor control device 210 and subsequently displayed by enabling pixels within a flat-panel monitor screen 215. The pixels are illuminated by a backlight 220, the brightness of which effects the brightness of the pixels and therefore the brightness of the display image.

Figure 2A:
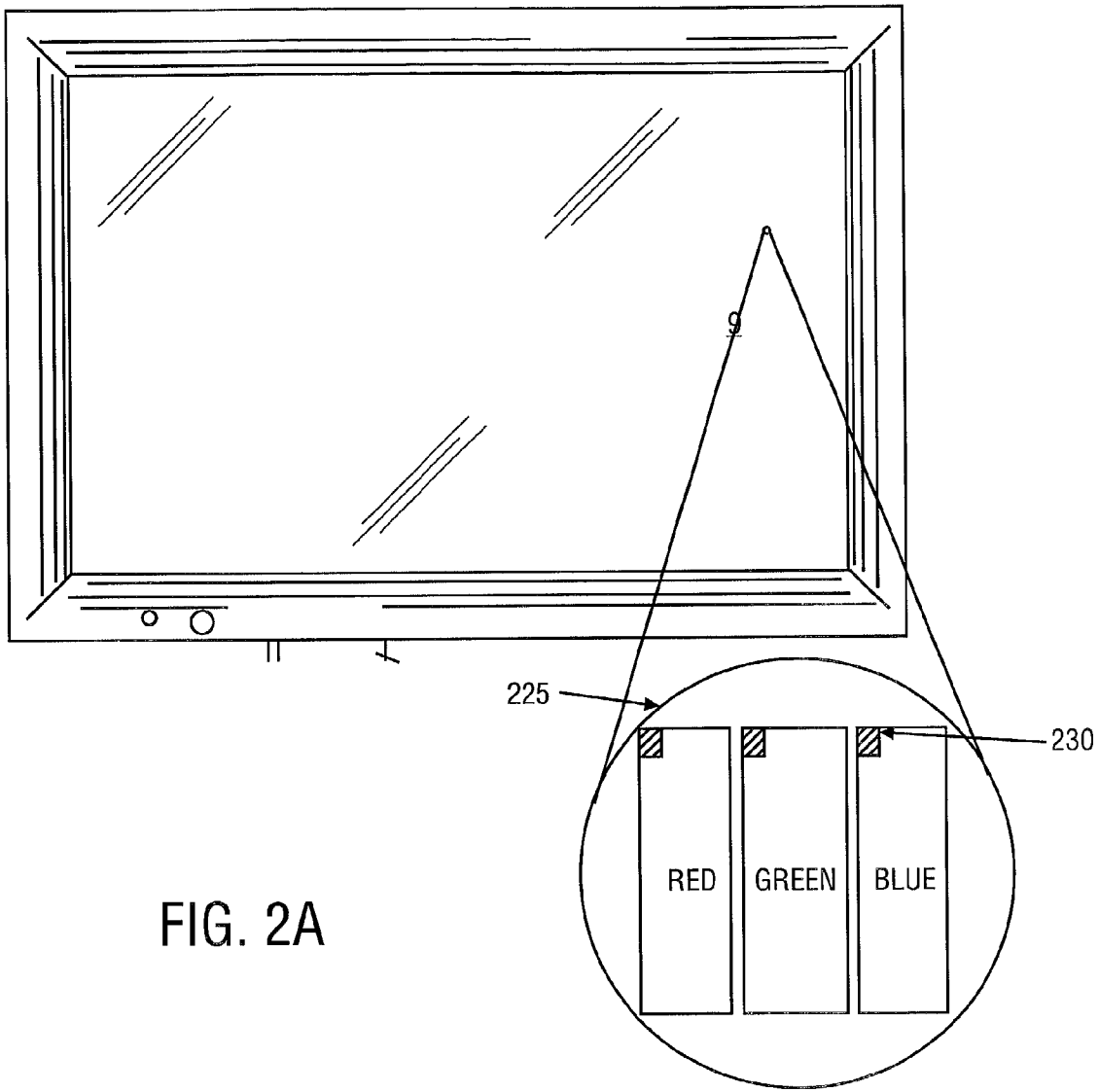
FIG. 2*a* illustrates a pixel within a flat-panel display monitor in accordance with one embodiment.

FIG. 2*a* illustrates a group of pixels within a flat-panel monitor screen in accordance with one embodiment. In one embodiment, the pixels are formed using Thin Film Transistor (TFT) technology, and each pixel is composed of three sub-pixels 225 that, when enabled, cause a red, green, and blue (RGB) color to be displayed, respectively. Each sub-pixel is controlled by a TFT 230. A TFT enables light from a display backlight to pass through a sub-pixel, thereby illuminating the sub-pixel to a particular color. Each sub-pixel color may vary according to a combination of bits representing each sub-pixel. The number of bits representing a sub-pixel determines the number of colors, or color depth, that may be displayed by a sub-pixel. By increasing the number of bits that are used to represent each sub-pixel, the number of colors that each sub-pixel represents increases by a factor of $2^N$, where "N" is the color depth of a sub-pixel.

For example, a sub-pixel represented digitally by 8 bits may display $2^8$ or 256 colors. A brighter or dimmer shade of a color being displayed by a pixel can be achieved by scaling the binary value representing each sub-pixel color (red, green, and blue, respectively) within the pixel. The particular binary values used to represent different colors depends upon the color-coding scheme, or color space, used by the particular display device. By modifying the color shade of the sub-pixels (by scaling the binary values representing sub-pixel colors) the brightness of the display image may be modified on a pixel-by-pixel basis. Furthermore, by modifying the color shade of each pixel, the amount of backlight necessary to create a display image of a particular display image quality can be reduced accordingly.

Display Image

Figure 3:
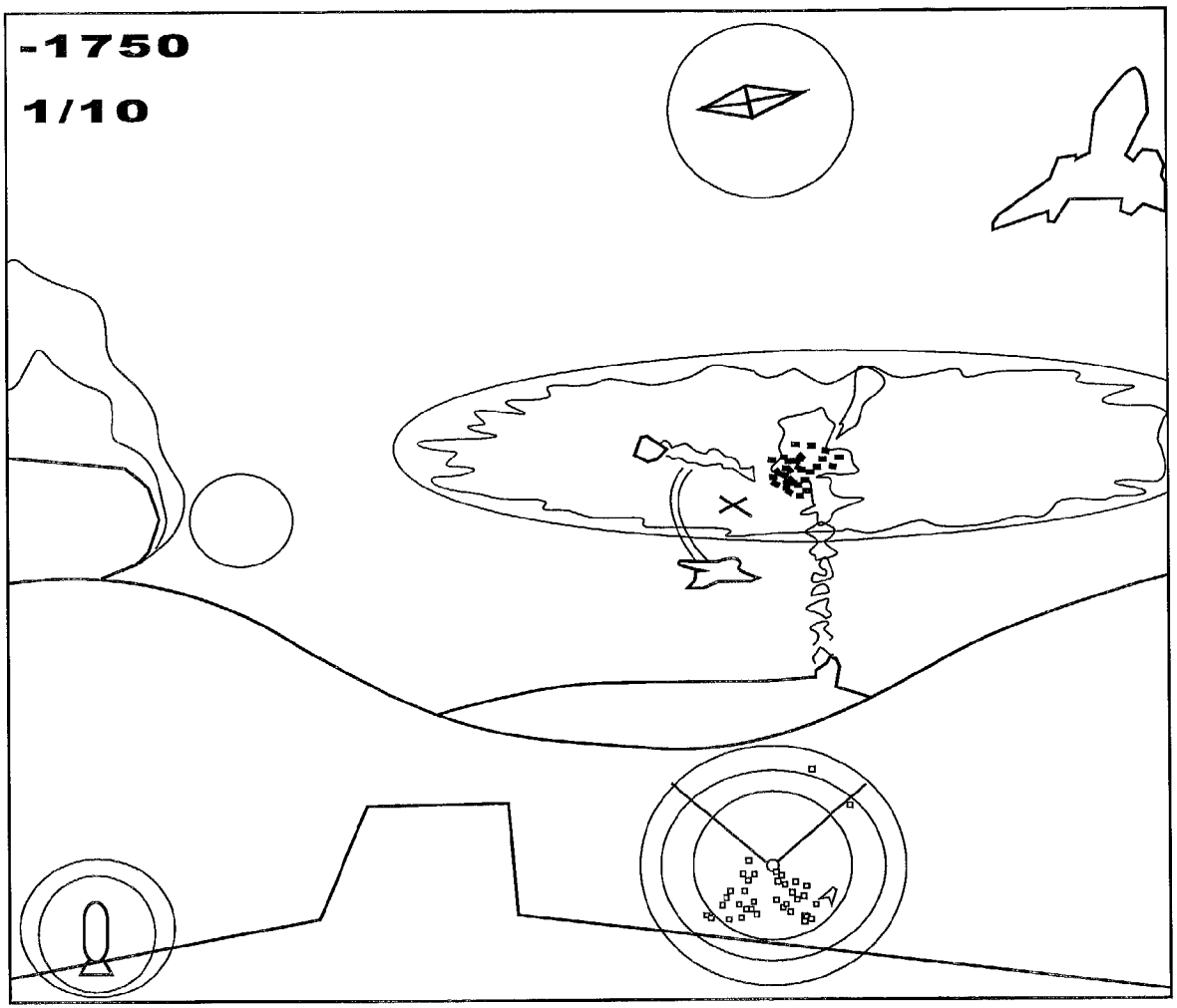
FIG. 3 illustrates a display image in accordance with one embodiment.

FIG. 3 is an example of a typical display image in accordance with one embodiment. In one embodiment, the display image is generated by a software application being executed within a mobile computer system, such as in FIG.

1, and displayed on a flat panel display. In one embodiment, the software application is a computer game using 3-D graphics acceleration features of the display device. However, the software application may be a program that causes a 2-D graphics image to be generated.

Figure 3A:
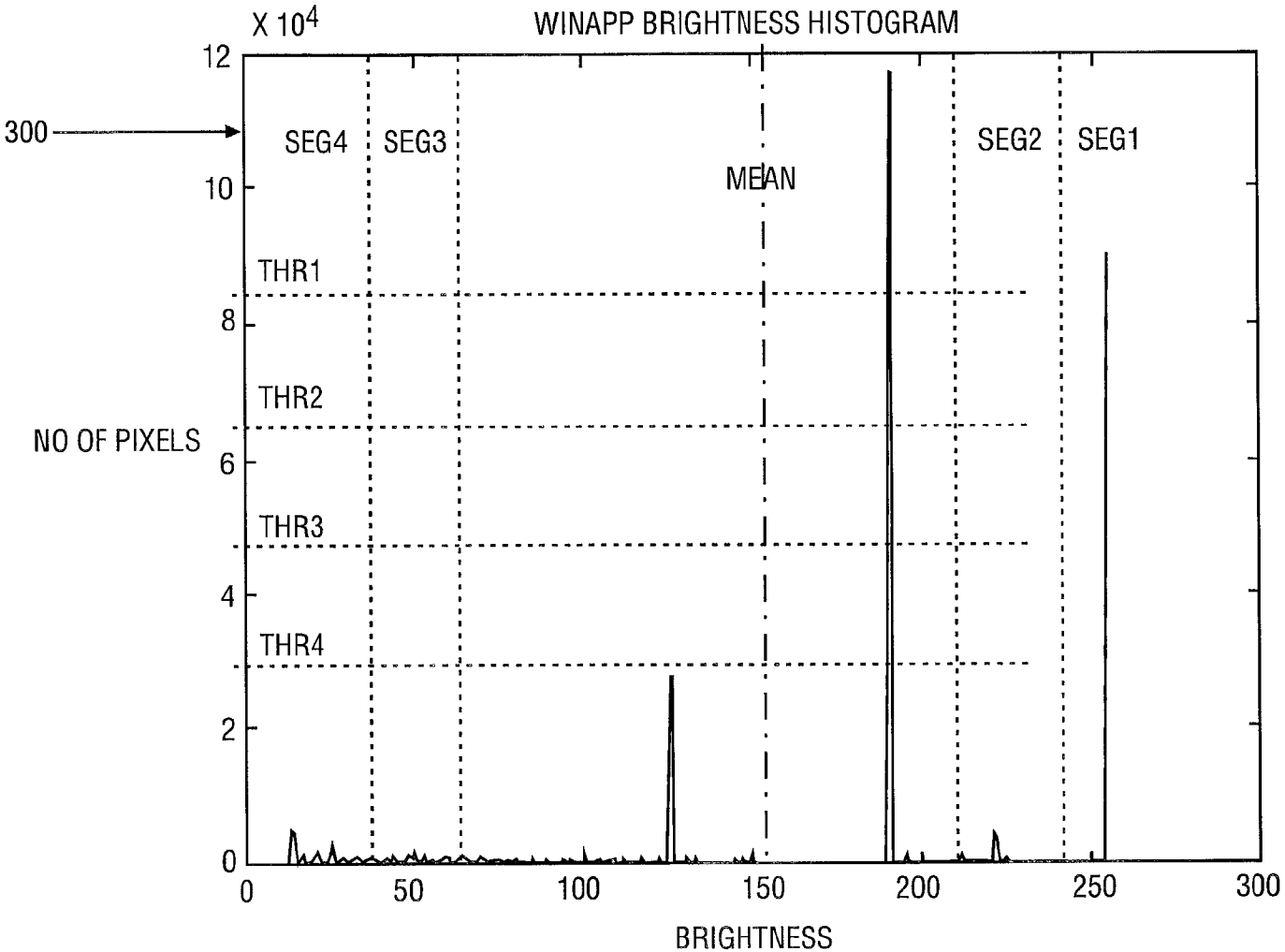
FIG. 3*a* is a histogram illustrating the relationship between an LCD image brightness and the number of pixels used to display the image.

FIG. 3*a* is a display image brightness histogram according to one embodiment. In one embodiment, brightness indicators within a graphics display device detect brightness of pixels within a display image. By interpreting the brightness indicators, the number of pixels that are displaying a range of colors within a particular color segment may be determined. Color segments are defined by a range of color displayed by pixels within a particular color depth. For example, in one embodiment, each pixel is capable of displaying any of 256 colors. Therefore, four segments of 64 colors (256 colors, total) each may be detected and accumulated within the histogram of FIG. 3*a*. In one embodiment, the histogram of FIG. 3*a* is calculated by hardware. However, in other embodiments, alternative implementations may be realized, including a software implementation.

Figure 4:
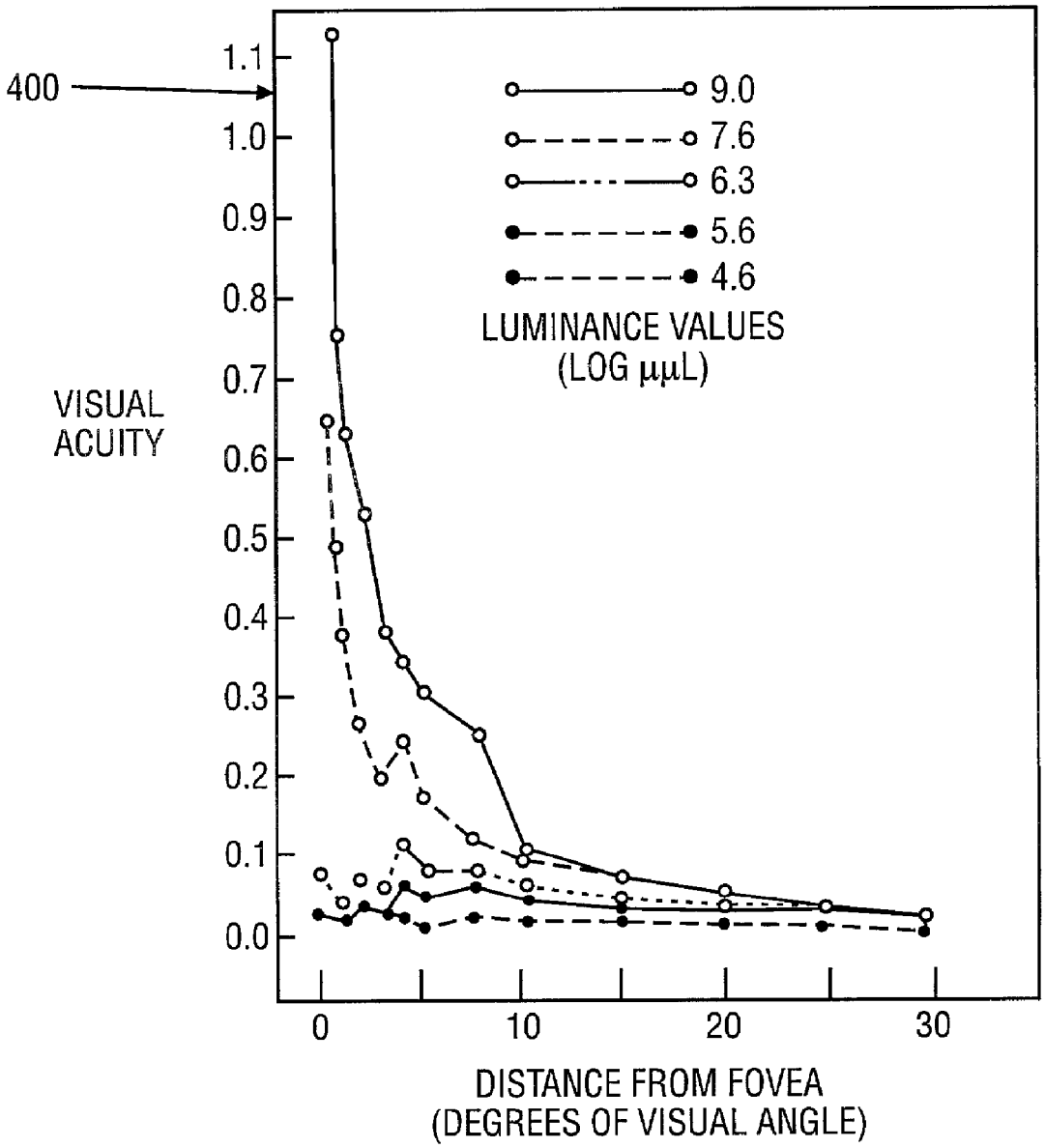
FIG. 4 illustrates a relationship between visual acuity and a user's distance from the fovea of an LCD in a mobile computing system.

FIG. 4 illustrates the effect of various display image luminance levels on visual acuity of a display image. Particularly, FIG. 4 illustrates 400 that the acuity (sharpness) of an image decreases significantly with only a relatively small change in display image luminance. Therefore, in order to maintain a display image quality, a display image must be illuminated within an acceptable range. Display image luminance may be effected by either increasing display image brightness (by varying the color shade of individual pixels) or increasing backlight brightness. The latter is undesirable in mobile computer systems that rely on battery power to operate, as the backlight tends to consume a significant amount of power.

A Display System

Figure 5:
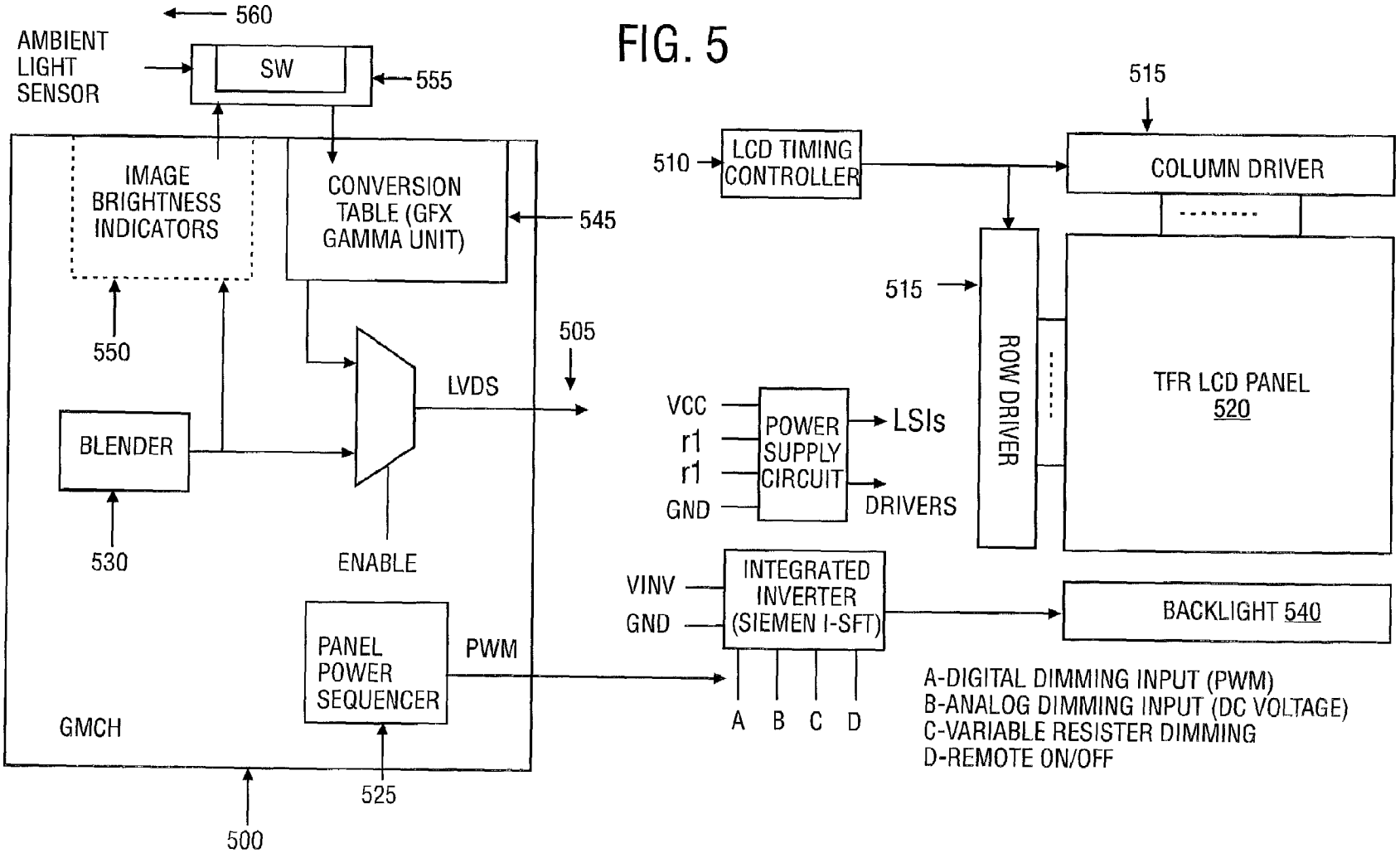
FIG. 5 is a block diagram illustrating a display system according one embodiment.

FIG. 5 illustrates a display system according to one embodiment. In one embodiment, a display device 500 generates display signals 505, which enable an LCD timing controller 510 to activate appropriate column and row drivers 515 to display an image on a flat-panel display monitor 520. In one embodiment, the display device includes a Panel Power Sequencer (PWM) 525, a blender unit 530, and a graphics gamma unit 535. The PWM controls luminance (brightness) of a backlight 540 within the flat-panel display monitor. A blender unit creates an image to be displayed on a display monitor by combining a display image with other display data, such as textures, lighting, and filtering data. A display image from the blender unit and the output of the gamma unit can be combined to create a Low Voltage Display Signal (LVDS) 505, which is transmitted to a flat-panel display device. The LVDS signal may be further translated into other signal types in order to traverse a greater physical distance before being translated to an appropriate display format and subsequently displayed on a flat-panel display monitor.

The graphics gamma unit 545 effects the brightness of an image to be displayed on a display monitor by scaling each sub-pixel color. In one embodiment, a graphics gamma unit can be programmed to scale the sub-pixel color on a per-pixel basis in order to achieve greater brightness in some areas of the display image, while reducing the brightness in other areas of the display image. FIG. 5 further illustrates one embodiment in which a unit 550 containing image brightness indicators samples the display image prior to it being translated to LVDS format. The display image brightness indicators detect a display image brightness by monitoring and accumulating pixel color within the display image. The display image brightness indicators can then indicate to the software program the brightness of certain features within the display image, such as display image character and background brightness.

Satisfying Power Management While Maintaining Visual Quality

Figure 6:
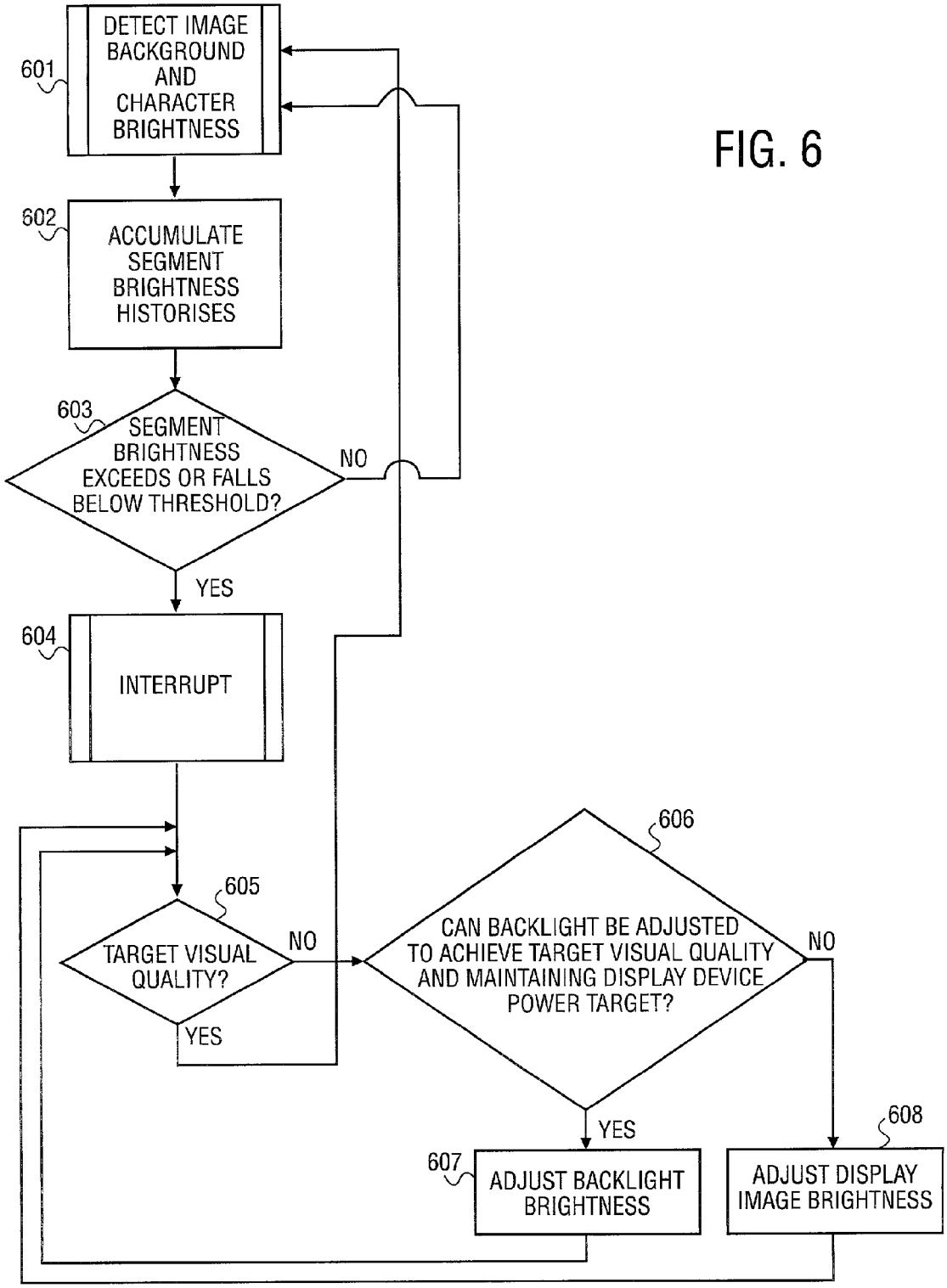
FIG. 6 is a flow diagram illustrating control of a display image brightness according to one embodiment.

FIG. 6 illustrates a method for maintaining a display image visual quality while satisfying a display device power requirement. In one embodiment, brightness indicators detect 601 the brightness of features within the display image, such as character brightness and background brightness. Information from the brightness indicators is accumulated in order to maintain a historesis of color segment brightness 602, which is continually compared against threshold levels corresponding to each color segment. If a color segment brightness level exceeds or falls below the respective segment threshold by a certain amount 603, this information is relayed to a software program 555, which determines whether the display image brightness or backlight brightness should be adjusted. In one embodiment, when a color brightness level exceeds or falls below a threshold by an amount, an interrupt is generated 604 causing a software program to either program the graphics gamma unit to adjust the display image brightness or enable the PWM to adjust the display backlight brightness in order to maintain a pre-determined display image quality 605. In one embodiment, if a target display image quality can be achieved by adjusting the backlight brightness while maintaining a target display device power target 606, then the PWM will be programmed accordingly 607. Otherwise, the target display image quality will be achieved by adjusting the display image brightness 608 by programming the graphics gamma unit accordingly. In other embodiments, other decision algorithms may be used to determine whether a display image brightness should be changed or backlight brightness should be modified in order to achieve or maintain an image quality while achieving or maintaining a power-consumption target. Furthermore, although a software program is used to implement the algorithm in one embodiment, in other embodiments, a hardware device may be used to perform similar functions as the software program in FIG. 5.

In addition to character and background display image brightness being detected in order to evaluate and adjust display image quality, other factors effecting display image quality may also be considered. In one embodiment, an ambient light sensor 560 is used to determine the brightness of ambient light surrounding a display monitor, in which the display image will be displayed. The image may then be adjusted to account for ambient light brightness.

A pre-determined display image quality can be achieved by maintaining a relationship among a set of display image properties. In one embodiment, a relationship among a set of display image properties is represented by a ratio of display image properties. In one embodiment, the display image properties include ambient light brightness, display character brightness, and background brightness. In other embodiments, other display image properties may be used to maintain or achieve a display image quality. In one embodiment, a ratio among display image properties is represented by the values, 10:3:1, which correspond to character brightness, ambient light brightness, and background brightness, respectively. This ratio may be different in other embodiments. In one embodiment, a software program maintains a display image brightness ratio by interpreting display image brightness indicators and ambient light brightness information. The software program may then adjust display image brightness and/or backlight brightness in order to achieve a pre-determined display image quality by programming the graphics gamma unit and/or PWM accordingly.

In one embodiment, the display image quality is represented by a pre-determined ratio of display image properties. However, in other embodiments, the display image quality may not be pre-determined, but may vary according to a decision-making algorithm, such as would be embodied in a software program or hardware circuit. Furthermore, in other embodiments, the display image quality may be represented by means other than a ratio of display properties. In one embodiment, a ratio of display image properties used to represent a display image quality includes display image character brightness, display image background brightness, and ambient light brightness. In other embodiments, more or fewer display image properties may be used to represent a display image quality.

While this invention has been described with reference to illustrative embodiments, this description is not intended to be construed in a limiting sense. Various modifications of the illustrative embodiments, as well as other embodiments , which are apparent to persons skilled in the art to which the invention pertains are deemed to lie within the spirit and scope of the invention.

What is claimed is:

1. A method comprising:

detecting at least one graphics accelerator power state;

adjusting a backlight brightness in a display monitor in response to detecting the at least one graphics accelerator power state;

adjusting a display image brightness in response to adjusting the backlight brightness to maintain a pre-determined display image quality represented by a relationship among a plurality of display image properties.

2. The method of claim 1 wherein the relationship is a ratio of values, the values-representing the plurality of display image properties.

3. The method of claim 1 wherein the plurality of display image properties comprises:

a display image character brightness;

an ambient light brightness;

a display image background brightness.

4. The method of claim 1 wherein the display monitor is a flat panel display.

5. The method of claim 1 wherein the display image brightness is adjusted by a graphics gamma unit.

6. The method of claim 1 wherein adjusting the backlight brightness contributes to satisfying the at least one power state requirement.

7. A method comprising:

displaying a display image on a display monitor;

detecting a display image brightness;

adjusting the display image brightness by adjusting a display character brightness or a background brightness in response to detecting the display image brightness and detecting a power state of a graphics accelerator corresponding to the display image.

8. The method of claim 7 further comprising maintaining a ratio of: values, the values representing a plurality of display image properties.

9. The method of claim 8 wherein at least one of the plurality of display image properties is effected by a backlight brightness, the backlight brightness being associated with the display monitor.

10. The method of claim 8 wherein at least one of the plurality of display image properties is effected by a software application being executed within a computer system, the computer system being coupled to the display monitor.

11. The method of claim 8 wherein the plurality of display image properties comprises an ambient light brightness.

12. An apparatus comprising:

a first unit to adjust a backlight brightness in response to detecting a graphics accelerator power state;

a second unit to adjust a display image brightness in response to an adjustment of the backlight brightness.

13. The apparatus of claim 12 further comprising:

a third unit to detect an ambient light brightness, wherein the second unit is to adjust the display image brightness in response to detecting the ambient light brightness.

14. The apparatus of claim 13, wherein the second unit and the third unit are the same functional unit.

15. The apparatus of claim 12, wherein the display image brightness includes character brightness and background brightness.

16. The apparatus of claim 15, wherein a contrast between the character brightness and the background brightness is to be changed in response to an adjustment to the backlight brightness.

17. The apparatus of claim 15, wherein a contrast between the character brightness and the background brightness is to be changed in response to an adjustment to the graphics accelerator power state.

18. A system comprising:

a display monitor;

a graphics accelerator to generate a display image on the display monitor, the display image having a character brightness and a background brightness;

a first unit to adjust the character brightness and the background brightness in response to a change in power state of the graphics accelerator.

19. The system of claim 18, wherein the display monitor includes a backlight generation unit.

20. The system of claim 19, wherein the first unit is to adjust the character brightness and the background brightness in response to a change in a backlight generated by the backlight generation unit.

21. The system of claim 18 further comprising an ambient light detector.

22. The system of claim 21, wherein the first unit is to adjust the character brightness and the background brightness in response to a change in ambient light detected by the ambient light detector.

23. A machine-readable medium having stored thereon a set of instructions, which if executed by a machine cause the machine to perform a method comprising:

detecting a first graphics accelerator power state;

adjusting a backlight brightness in a display monitor in response to detecting the first graphics accelerator power state; and adjusting a display image brightness in response to adjusting the backlight brightness.

24. The machine-readable medium of claim 23 wherein the method further comprises maintaining a display image quality in response to detecting the backlight brightness, the display image quality being represented by a relationship among a plurality of display image properties.

25. The machine-readable medium of claim 24 wherein the plurality of display image properties include a display image character brightness, an ambient light brightness, and a display image background brightness.

* * * * *